US008967602B1

(12) United States Patent
Prestidge

(10) Patent No.: US 8,967,602 B1
(45) Date of Patent: Mar. 3, 2015

(54) HAND PROTECTION DEVICE

(76) Inventor: Pat A. Prestidge, Elgin, IL (US)

( * ) Notice: Subject to any disclaimer, the term of this patent is extended or adjusted under 35 U.S.C. 154(b) by 461 days.

(21) Appl. No.: 13/463,284

(22) Filed: May 3, 2012

(51) Int. Cl.
*B25B 11/00* (2006.01)

(52) U.S. Cl.
USPC ..... 269/3; 269/6

(58) Field of Classification Search
CPC ..... B25B 1/2447; B25B 3/00; B25B 5/04; B25B 5/067; B25B 5/085; B25B 5/101; B25B 5/125; B25B 33/00
USPC ..... 269/3, 5, 6, 95; 29/244, 255, 270, 278
See application file for complete search history.

(56) References Cited

U.S. PATENT DOCUMENTS

| | | | | |
|---|---|---|---|---|
| 1,351,028 | A | 8/1920 | Donovan et al. | |
| 3,667,128 | A * | 6/1972 | Morgan | 33/529 |
| 5,494,553 | A * | 2/1996 | Colucci | 156/580 |
| 5,706,520 | A | 1/1998 | Thornton et al. | |
| 7,780,668 | B2 * | 8/2010 | Steiner et al. | 606/79 |
| 2008/0255623 | A1 * | 10/2008 | Steiner et al. | 606/86 R |
| 2009/0152783 | A1 * | 6/2009 | Sigler et al. | 269/6 |

* cited by examiner

*Primary Examiner* — Lee D Wilson

(57) ABSTRACT

One embodiment of a hand protector device suitable for protecting the hand of the user of pneumatic or other nailing devices, by providing a shield sufficient to stop, impede, or deflect the momentum of a nail projectile from a nailing device. The device also contains gripping plates to easy the user's grip upon the materials to be fastened by the nailing device. In addition, the device is secured solely by the power of the user's grip, such that it can easily be removed simply by the user relaxing his or her grip on the device.

7 Claims, 2 Drawing Sheets

HAND PROTECTION DEVICE

BACKGROUND

1. Field

This application relates to the present invention in the field of safety and protection devices for use by power tool operators. In particular the present invention provides a device to protect the power tool operator's hand from misfires or other errant projectiles from a pneumatic or otherwise powered nailing device.

2. Prior Art

There are a number of widely used nailing devices commonly used in almost all forms of modern construction. These devices are often pneumatically powered, and can drive nails at very high velocities. While operating these nailing devices, the user or other helper must hold materials to be fastened, often two boards of lumber, together to ensure that the nail strikes true and sinks into the second board. To ensure a proper fastening, the user or helper must use their hands close to the nailing device, and in the direction of its fire. The nail projectiles often, whether due to nailing device malfunction, user error, or poor quality of materials being fastened by the nailing device, can and do cause serious damage to a user's unprotected hand due to the proximity of the hand holding the materials to be fastened together.

In addition, users of these nailing devices often have many other job tasks in addition to using the nailing device. These users do not want to struggle with removing devices that are securely fastened to the hand with straps, velcro, gloved implements, or otherwise, as they need to be able to quickly remove or set down any tools so that they can perform other duties at a moment's notice. Due to these users' desire for fine control and speed, they often even forgo the protection of simple work gloves as too cumbersome to switch from task to task quickly while working.

There are a great deal of hand protection devices that exist, but none of these are specifically designed toward protection from nailing devices, nor provide adequate protection from them.

U.S. Pat. No. 1,351,028 to Donovan (1920) discloses a hybrid glove-handshield designed to protect riveters hands from the heat of the operation of their tools and materials used. The device is comprised of flexible and heat resistant materials such as leather and asbestos. However, the device is not designed to stop or deflect high impact blows from the outside of the user's hand, such as a projectile from a nailing device, especially those projectiles with a high piercing capacity, such as a nail.

U.S. Pat. No. 5,706,520 to Thornton (1998) discloses a jointed hand protection device from punctures to the fingers by hypodermic needles and other sharp instruments. This device only covers part of the user's thumb and index finger. The device does not cover any of the other areas of the hand which are likely to be struck by an errant nailing device projectile, such as the hand and wrist, as well as the remaining uncovered fingers. In addition, this device would not be large enough, nor have enough strength to stop or deflect the high velocity projectiles from a nailing device.

SUMMARY

The present invention provides an apparatus to address the drawbacks noted above by providing a protective tool to be used by operators of nailing devices, by stopping, impeding, or deflecting the momentum of a high velocity projectile from these nailing devices.

Many embodiments are conceived, but all provide a pivoting, two-part or more shield to completely protect the entire hand and wrist of the operator's hand not holding the nailing device, from the direction of the of the nailing device.

This shield is two or more parts, held together by a rivet, screw, or any other applicable axis to allow opening and closing of the shield. The shield is oriented sideways on the user's hand in the direction of the thumb to protect against projectiles from the direction of the used nailing device. The material of this shield may be stiff or flexible, so long as it is sufficient to stop, impede, or deflect the momentum of a projectile fired from a nailing device. Other embodiments of the shield are conceived to provide a textured surface of the shield to allow the shield to catch the nail more securely so that it can help prevent ricochets of the nail projectiles.

The device includes an opening that fits the width of the most commonly used framing materials, such as the 1¾ inch wide 2×4, 2×6, or 2×8 boards. Other embodiments are conceived which will have different width openings to fit other less common width framing materials.

The device is fit over the second board to be attached, and held into place by the user's grip. Other embodiments are conceived to apply texture to the interior of the shield holding the face of the board, to aid grip of the device onto said board.

The device will have finger loops, holes, or tabs to aid the user in opening and closing the jaws of the device, but the device will be held onto the user's hand by the grip of the user's hand itself. If the user's grip relaxes, the device will easily come off of the user's hand. Other embodiments are conceived that implement contoured surfaces to ease the ergonomic structure for the users' hands but still release easily when the users' grip is released.

In use, the device will provide protection to the users' hands, fingers and wrists from errant projectiles misfired, or that have over-penetrated the materials, and prevent a nail from striking and penetrating the hands of the user.

DRAWINGS

Figures

DRAWINGS

Reference Numerals

10—the whole device
20—posterior shield plate
30—anterior shield plate
40—rivet, bolt or pivot joint
50—gripping plate(s)
60—finger tabs

DETAILED DESCRIPTION

Figure 1A:
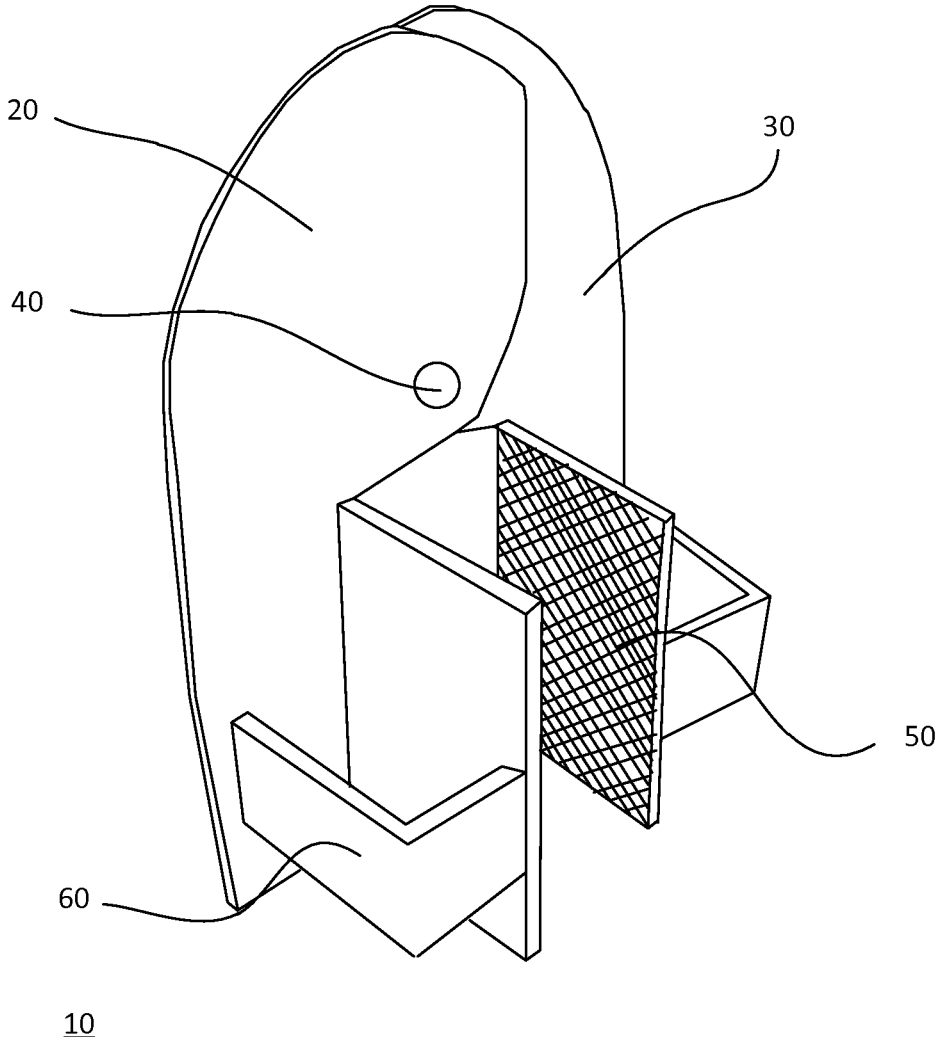
FIG. 1A shows the device from the rear.
Figure 1B:
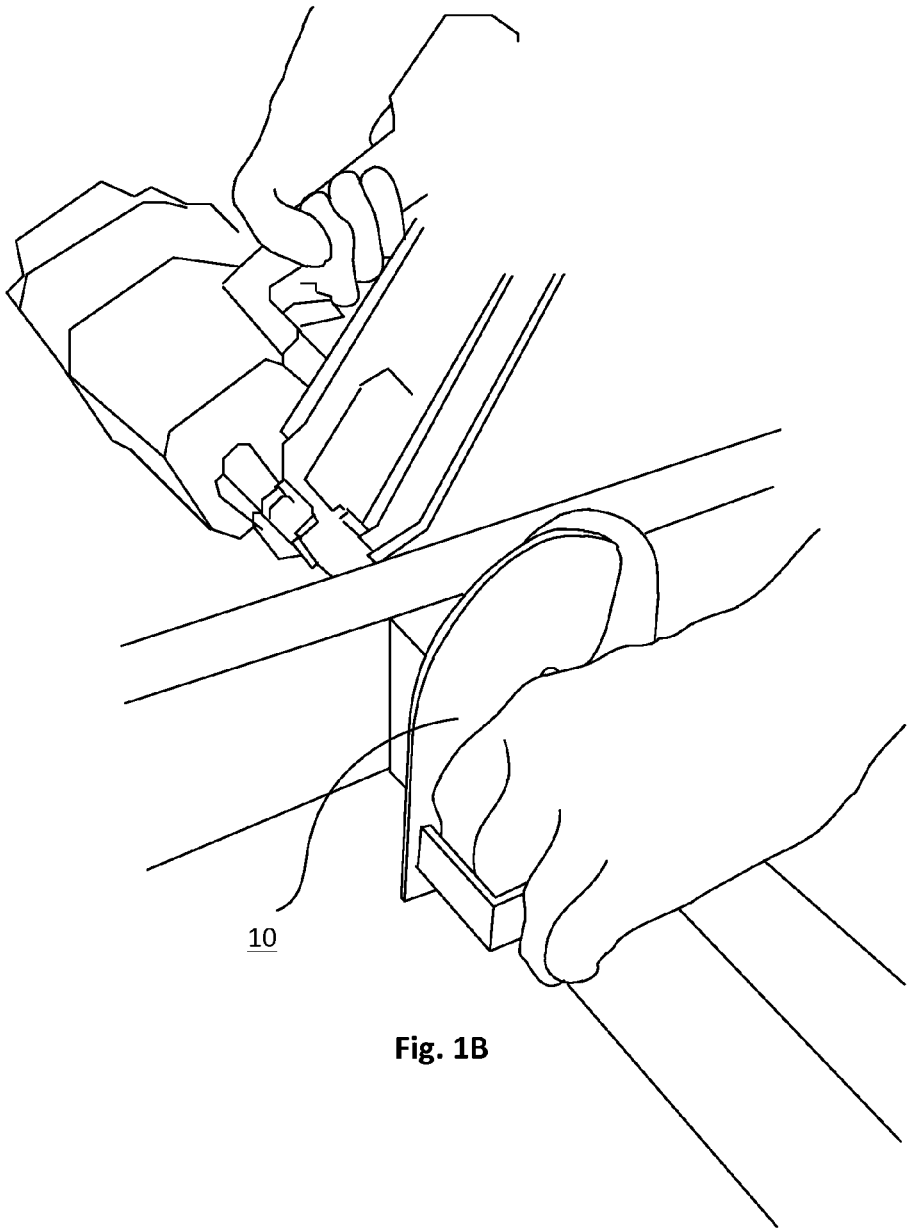
FIG. 1B shows the device as it is intended to be used to protect the user's hand.

FIGS. 1A and 1B—First Embodiment

One embodiment of the device is illustrated in FIG. 1A (rear view) and FIG. 1B (view as intended to be used). The 20 posterior and 30 anterior shield plates are affixed together with a 40 rivet, bolt, or other applicable pivot joint. These shield plates are comprised of stiff or flexible materials, sufficient to stop, impede, or deflect the majority of the momentum of a nail projectile from a nailing device. The materials may be metallic, plastic, or composite, so long as they meet the above requirements.

The 50 gripping plates may be attached or extra material bent backwards from the same 20 and 30 shield plates with the shield plates each having an inner surface having a L shaped recess with a first side being parallel and a second side being perpendicular on each the shield plates. The interior surface of the 50 gripping plates may or may not be textured, or fitted with studs, spikes or other gripping aids.

The user will insert his or her fingers on either side of the gripping plates but behind the 60 finger tabs, so that when the user opens or closes their thumbs and fingers, the device will open and close as well.

The device is held onto the user's hand merely by the user's grip between the 50 grip plates and 60 finger tabs. If the user releases his or her grip, the device will fall off of the user's hand.

Although the above descriptions contain many specificities, these should not be construed as limiting the scope of the embodiments but as merely providing illustrations of some of the presently preferred embodiments. For example, other embodiments are contemplated such as: replacing the 60 finger tabs with alternatives such as tabs bent down from the 50 gripping plates, a textured face of the 20 and 30 shield plates so as to catch a nail projectile, to prevent it from ricocheting or deflecting off of the shield plates as easily, or different width openings between the 50 gripping plates to accommodate different width materials.

Thus the scope of the embodiments should be determined by the appended claims and their legal equivalents, rather than by the examples given.

The invention claimed is:

1. A device for reducing the risk of injury to an user's hand from projectiles, comprising:

at least two shield plates with an inner and outer surface that are pivotably connected by a fastener wherein each said inner surface having a L shaped recess with a first side being parallel and a second side being perpendicular on said each shield plate;

at least two gripping plates each with an inner and outer surface, where said gripping plates are essentially perpendicular to said at least two shield plates and are connected with said L shaped recesses of said first parallel sides of said at least two of said shield plates; and finger restraints connected with said outer surface of said gripping plates.

2. The device of claim 1 wherein said inner surfaces of said at least two gripping plates are essentially parallel at a space between said inner surfaces L shaped recess having a range of 1.5 inches to 3.5 inches.

3. The device of claim 1 wherein said finger restraints comprising first and second members in a L shaped configuration.

4. The device of claim 1 wherein said at least two gripping plates overlap each other with said fastener being connected within aligning apertures in said at least two gripping plates.

5. The device of claim 1 wherein said inner surface of said gripping plates are textured.

6. The device of claim 1 wherein said outer surfaces of said at least two shield plates are textured.

7. A method of reducing the risk of injury to a construction worker from accidentally being struck in the hand or wrist by errant projectiles from a nailing device comprising:

selecting a hand protector featuring at least two shield plates which cover the user's hand and wrist from the direction of the nailing device, two or more gripping plates, and finger restraints; and placing worker's palm around said gripping plates and worker's fingers and thumb in said finger restraints; and manipulating said hand protector to grip and hold the materials within a L shaped recesses including parallel and perpendicular sides which are formed on an inners surface of said two shield plates to be fastened at a distance from the nailing device no less than the length of the nail projectile being used in said nailing device;

selecting a hand protector featuring at least two shield plates which cover the user's hand and wrist from the direction of the nailing device, two or more gripping plates which are connected to said parallel sides of said two shield plates, and finger restraints; and placing worker's palm around said gripping plates and worker's fingers and thumb in said finger restraints; and manipulating said hand protector to grip and hold the materials to be fastened at a distance from the nailing device no less than the length of the nail projectile being used in said nailing device.

* * * * *